US011913326B2

(12) United States Patent
Hough et al.

(10) Patent No.: US 11,913,326 B2
(45) Date of Patent: Feb. 27, 2024

(54) DOWNHOLE COMMUNICATION SYSTEMS

(71) Applicant: Schlumberger Technology Corporation, Sugar Land, TX (US)

(72) Inventors: Steven Hough, Minchinhampton (GB); Edward Richards, Cheltenham (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 34 days.

(21) Appl. No.: 17/771,886

(22) PCT Filed: Oct. 29, 2020

(86) PCT No.: PCT/US2020/057972

§ 371 (c)(1),
(2) Date: Apr. 26, 2022

(87) PCT Pub. No.: WO2021/087119

PCT Pub. Date: May 6, 2021

(65) Prior Publication Data

US 2022/0372870 A1 Nov. 24, 2022

Related U.S. Application Data

(60) Provisional application No. 62/928,377, filed on Oct. 31, 2019.

(51) Int. Cl.
*E21B 47/18* (2012.01)
*E21B 47/24* (2012.01)

(52) U.S. Cl.
CPC ..... *E21B 47/18* (2013.01); *E21B 47/24* (2020.05)

(58) Field of Classification Search
CPC ..... E21B 47/18; E21B 47/24
See application file for complete search history.

(56) References Cited

U.S. PATENT DOCUMENTS

| | | | | |
|---|---|---|---|---|
| 4,386,422 | A * | 5/1983 | Mumby | E21B 47/22 367/83 |
| 7,975,392 | B1 * | 7/2011 | Spaulding | E21B 47/022 33/313 |
| 2003/0209365 | A1 * | 11/2003 | Downton | E21B 47/00 166/250.11 |
| 2008/0204270 | A1 * | 8/2008 | Aiello | E21B 47/18 340/855.4 |

(Continued)

FOREIGN PATENT DOCUMENTS

| | | | |
|---|---|---|---|
| WO | 2014190442 | A1 | 12/2014 |
| WO | 2017156107 | A1 | 9/2017 |

OTHER PUBLICATIONS

International Search Report and Written Opinion in International Patent Application No. PCT/US2020/057972, dated Feb. 2, 2022, 12 pages.

*Primary Examiner* — Brad Harcourt
(74) *Attorney, Agent, or Firm* — Jeffrey D. Frantz

(57) ABSTRACT

A system for downhole communication includes a roll stabilized platform and a mud pulse generator in communication with the roll stabilized platform. The mud pulse generator generates pressure pulses in a pattern that includes encoded data. A receiver receives the pressure pulses and the encoded data is decoded. The receiver is located at any location capable of receiving pressure pulses.

15 Claims, 12 Drawing Sheets

(56) References Cited

U.S. PATENT DOCUMENTS

| | | | | |
|---|---|---|---|---|
| 2010/0157735 | A1* | 6/2010 | Allan | E21B 47/24 367/83 |
| 2010/0307828 | A1* | 12/2010 | Hutin | E21B 47/18 175/56 |
| 2012/0032560 | A1* | 2/2012 | Ochoa | E21B 47/18 310/339 |
| 2016/0265351 | A1 | 9/2016 | Gajji et al. | |
| 2017/0284195 | A1 | 10/2017 | White et al. | |
| 2017/0359633 | A1 | 12/2017 | White et al. | |

* cited by examiner

DOWNHOLE COMMUNICATION SYSTEMS

CROSS-REFERENCE TO RELATED APPLICATIONS

This application claims the benefit of, and priority to, U.S. Patent Application No. 62/928,377, filed on Oct. 31, 2019 and titled "DOWNHOLE COMMUNICATION SYSTEMS" which application is incorporated herein by this reference in its entirety.

BACKGROUND

Downhole drilling tools often rotate to drill, ream, or otherwise degrade material in a downhole environment. Many downhole drilling tools include sections that rotate independently of each other. For example, roll stabilized platforms are often held rotationally stable with respect to a borehole wall, and used in directional drilling applications to provide a reference for an operator on the surface, or a downhole control unit, to direct the bit on a desired trajectory (e.g., to direct the azimuth and/or inclination of the bit). The roll stabilized platform may collect data, such as measurements from sensors, which may be beneficial to communicate from the roll stabilized platform to other portions of a drilling system.

SUMMARY

In some embodiments, a downhole communication system includes a roll stabilized platform and a mud pulse generator in communication with the roll stabilized platform. The system includes a receiver configured to receive a pressure pulse generated by the mud pulse generator.

In some embodiments, a method for downhole communication includes generating pressure pulses in a pattern using a mud pulse generator in communication with a roll stabilized platform. The pattern includes encoded data. The method further includes receiving the pressure pulses at a receiver and decoding the encoded data from the pattern.

In some embodiments, a method for downhole communication includes generating a first set of pressure pulses using a mud pulse generator in communication with a roll stabilized platform. The first set of pressure pulses are generated in a first pattern having a first frequency and received at a first receiver. A second set of pressure pulses may be generated at a downhole tool in a second pattern having a second frequency. The second set of pressure pulses may be received at a second receiver.

This summary is provided to introduce a selection of concepts that are further described below in the detailed description. This summary is not intended to identify key or essential features of the claimed subject matter, nor is it intended to be used as an aid in limiting the scope of the claimed subject matter.

Additional features and advantages of embodiments of the disclosure will be set forth in the description which follows, and in part will be obvious from the description, or may be learned by the practice of such embodiments. The features and advantages of such embodiments may be realized and obtained by means of the instruments and combinations particularly pointed out in the appended claims. These and other features will become more fully apparent from the following description and appended claims, or may be learned by the practice of such embodiments as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a cross-sectional view of a downhole connection, according to at least one embodiment of the present disclosure;

FIG. 2-2 is another cross-sectional view of the downhole connection of FIG. 2-1, according to at least one embodiment of the present disclosure;

DETAILED DESCRIPTION

Figure 1:
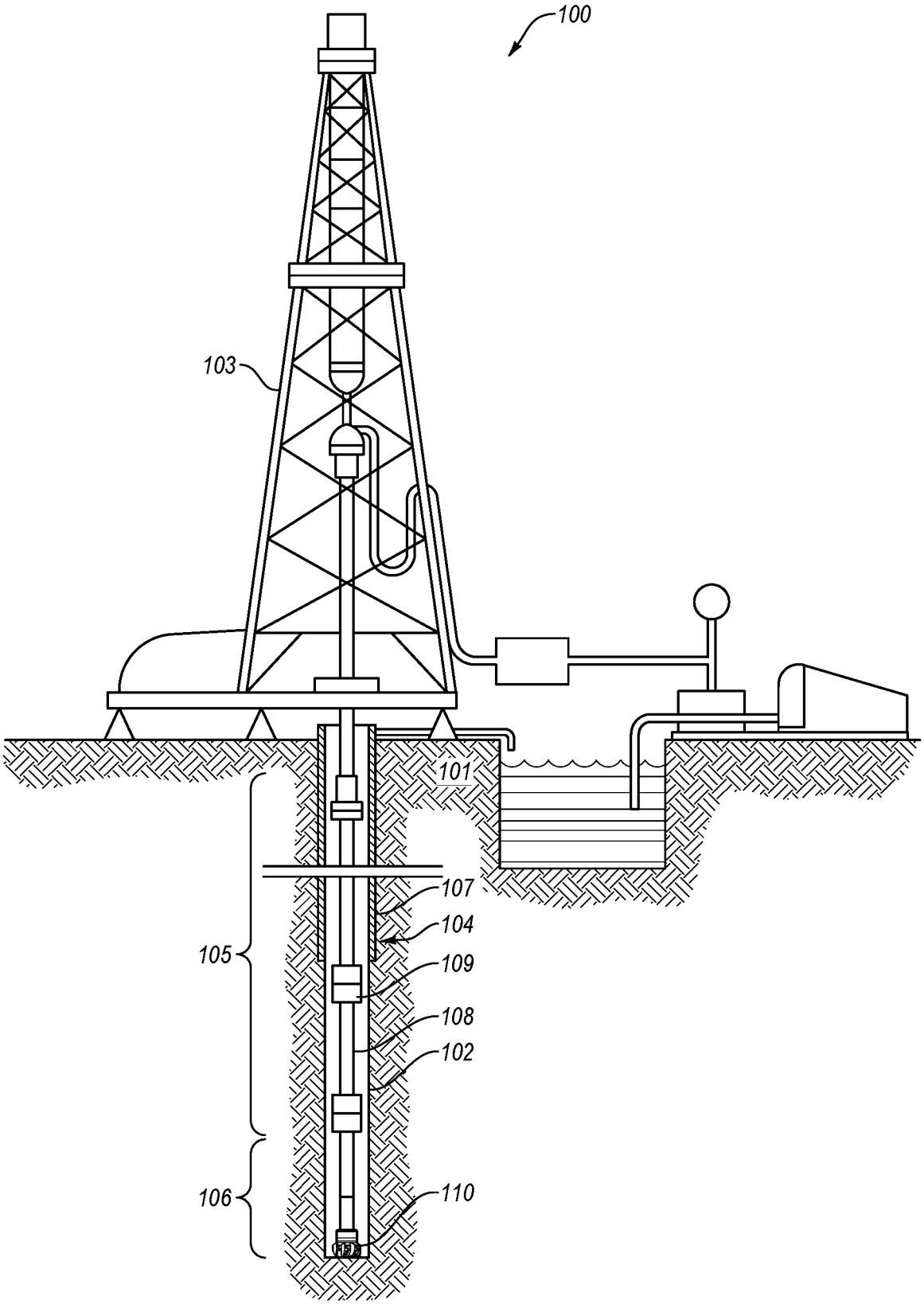
FIG. 1 is a drilling system, according to at least one embodiment of the present disclosure.

This disclosure generally relates to devices, systems, and methods for communicating information between a roll stabilized platform and other portions of a drilling system. FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling (MWD) tools, logging-while-drilling (LWD) tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory. In some embodiments, at least a portion of the RSS may be roll stabilized and may not rotate with the drill collar. In such embodiments, such a portion of the RSS may be geostationary or may be controlled in such a way so as to control the direction of the drill string.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Conventionally, communication between two subs that rotate at different rotational rates may be performed via a physical connection, such as a slip ring or other rotating physical connection known in the art. Alternatively, an electromagnetic signal may be wirelessly transmitted between two subs rotating at different rotational rates. However, slip rings and the like may be prone to wear, erosion, jamming, clogging, and combinations of the foregoing. Furthermore, electromagnetic signals are short range and potentially unreliable, especially in downhole environments, where downhole equipment, drilling fluid, rock formation, and other factors interfere with electromagnetic communication.

Figures 1, 2:
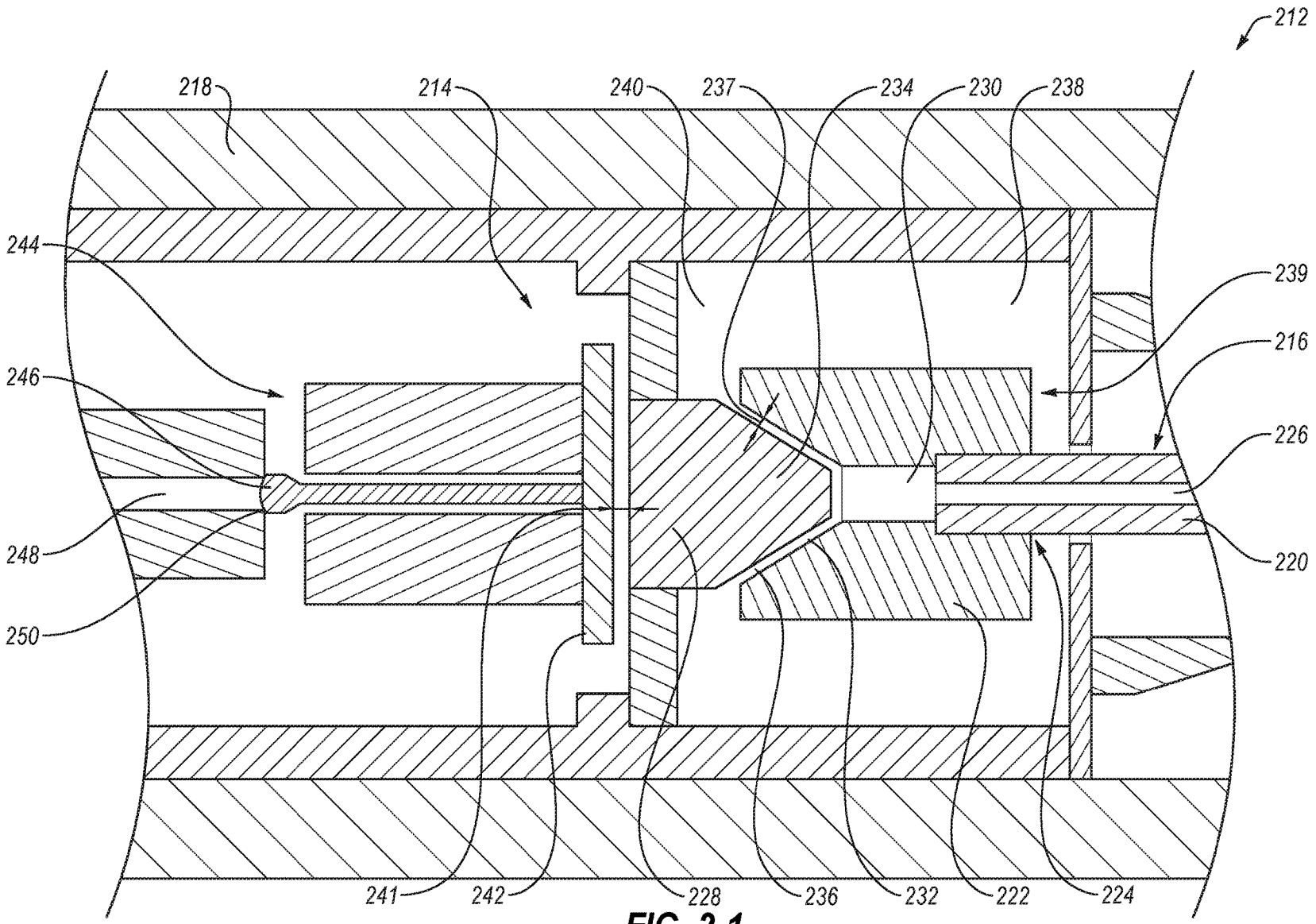
Figure 2:
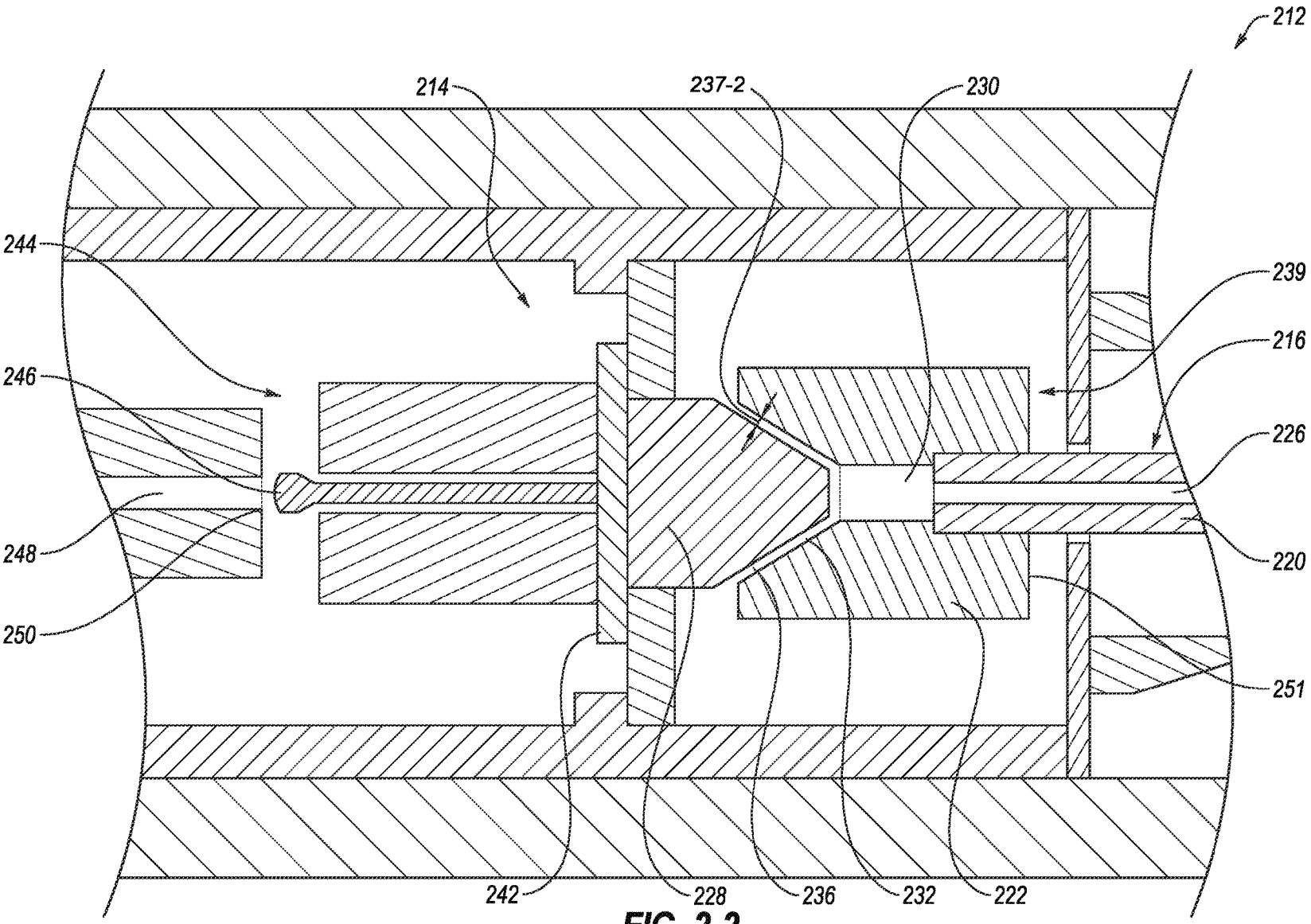

FIG. 2-1 is a representation of a downhole connection 212, according to at least one embodiment of the present disclosure. The downhole connection 212 may include a rotating member 214 and an independently rotating member 216. The rotating member 214 and the independently rotating member 216 may be rotationally independent of each other. For example, the rotating member 214 may include a downhole sub 218 that rotates in synch with the collar (e.g., at the drill rig 103 of FIG. 1) and/or the drill bit (e.g., the bit 110 of FIG. 1). In some embodiments, the downhole sub 218 may be a drill pipe (e.g., the drill string 105 of FIG. 1). In other embodiments, the downhole sub 218 may be a downhole tool, or a portion of the BHA (e.g., the BHA 106 of FIG. 1).

The independently rotating member 216 may include an independently rotating platform 220. The independently rotating platform 220 may rotate at a different rotational rate than the downhole sub 218. For example, the independently rotating platform 220 may be a roll stabilized system, such as a roll stabilized control unit of a rotary steerable system. In other examples, the independently rotating platform 220 may be the rotor of a mud motor. In still other examples, the independently rotating platform may be any other downhole element rotationally independent of the downhole sub 218. In further examples, the independently rotating member may be a non-rotating sleeve on a rotary steerable system.

In some examples, the rotating member 214 may rotate with a first rotational rate and the independently rotating platform 220 may rotate with a second rotational rate. In some embodiments, the first rotational rate may be the same as the second rotational rate. In other embodiments, the first rotational rate may be different from the second rotational rate. For example, the second rotational rate may be less than (i.e., with a lower RPM than) the first rotational rate. In some embodiments, the first rotational rate and the second rotational rate may be in the same direction (e.g., clockwise or counterclockwise). In other embodiments, the first rotational rate and the second rotational rate may be in opposite directions (e.g., clockwise or counterclockwise). In some embodiments, the second rotational rate may be zero with respect to an external frame of reference, such as gravity, magnetic north, grid north, true north, or the formation. In other examples, the second rotational rate may be greater than (i.e., with a higher RPM than) the first rotational rate.

In some embodiments, the first rotational rate may be zero or approximately zero. Therefore, the rotating member may not rotate relative to an external frame of reference. The independently rotating member may be driven by a downhole motor, such as a mud motor. In this manner, the independently rotating member may rotate with respect to both the rotating member and an external frame of reference.

The independently rotating platform 220 may be connected to a solenoid 222. The solenoid 222 may be rotationally fixed to the independently rotating platform 220. In other words, the solenoid 222 may rotate with the same rotational rate as the independently rotating platform 220. In some embodiments, the solenoid 222 may be located at the uphole end 224 of the independently rotating platform 220. For example, the independently rotating platform 220 may include an extension 226 that extends uphole past a body of the independently rotating platform (not shown). In other embodiments, the extension 226 may extend downhole from the independently rotating platform 220, and the downhole sub 218 may be downhole of the independently rotating platform 220. The solenoid 222 may be connected to the extension 226 with any type of connection, such as a threaded connection, a reverse-threaded connection, a bolted connection, a weld, a braze, an interference fit, a friction fit, or any other connection.

The rotating member 214 may include a magnetic conductor 228. In some embodiments, the magnetic conductor 228 may be rotationally fixed to the rotating member 214. The magnetic conductor 228 may be rotationally and/or longitudinally movable with respect to or relative to the solenoid 222. The solenoid 222 includes a central bore 230. In some embodiments, the central bore 230 may have an opening 232 having a non-uniform diameter relative to the rest of the central bore 230. The magnetic conductor 228 may include an end 234 shaped complementarily to the opening 232. In some embodiments, the magnetic conductor 228 may move longitudinally in and out of the opening 232.

In some embodiments, the magnetic conductor 228 may be manufactured from a magnetic material. For example, the magnetic conductor 228 may be manufactured from a steel alloy, a nickel alloy, or another type of magnetic material, such as a rare-earth magnet (e.g., neodymium or samarium alloy magnets).

A gap 236 may be present between the solenoid 222 and the magnetic conductor 228. The gap 236 may maintain a gap distance 237, or an open gap distance, between the solenoid 222 and the magnetic conductor 228 during operation of the solenoid 222. In this manner, the magnetic conductor 228 and the solenoid 222 may not contact. Preventing the solenoid 222 and the magnetic conductor 228 from contacting may reduce the number of physical connections between the rotating member 214 and the independently rotating member 216. This may reduce wear and therefore increase the life of the solenoid 222 and/or the magnetic conductor 228. Furthermore, this may improve reliability of the system, because the solenoid 222 and the magnetic conductor 228 may not get stuck or clog with respect to each other. Still further, this may reduce drag torque on the magnetic conductor 228. In at least one embodiment, the gap 236 may allow for lateral clearance if the downhole connection is bent or curved in a deviated borehole. Furthermore, the gap 236 may allow for thermal expansion and/or protection from contact during vibration or other movement of the solenoid 222 and the magnetic conductor 228 relative to each other.

In some embodiments, the gap 236 may be filled with air, such as standard atmospheric air. Filling the gap 236 with air may reduce the force required to move the magnetic conductor 228 and/or may increase and/or maximize how far the magnetic field is conducted with the magnetic conductor 228. In other embodiments, the gap 236 may be filled with another gas or gas mixture, including an inert gas such as nitrogen. In still other embodiments, the gap 236 may include a vacuum or a near-vacuum. In yet other embodiments, the gap 236 may be filled with a fluid, such as a water based fluid, an oil based fluid, drilling mud, or other fluid. In at least one embodiment, filling the gap 236 with a fluid may help to maintain an operating temperature of the solenoid 222.

In some embodiments, the gap distance 237 may be in a range having an upper value and a lower value, or upper and lower values including any of 0.1 mm, 0.5 mm, 1 mm, 2 mm, 3 mm, 4 mm, 5 mm, 6 mm, 7 mm, 8 mm, 9 mm, 10 mm, or any value therebetween. For example, the gap distance 237 may be greater than 0.1 mm. In other examples, the gap distance 237 may be less than 10 mm. In yet other examples, the gap distance 237 may be any value in a range between 0.1 mm and 10 mm. In at least one embodiment, it may be critical that the gap distance 237 is between 0.1 mm and 10 mm. The gap distance 237 may be sized such that a magnetic flux may flow through the magnetic conductor 228 and such that the magnetic conductor 228 may be magnetically attracted to the solenoid 222 when the solenoid 222 is activated.

The rotating member 214 may include a solenoid housing 238. The solenoid housing 238 may extend around the solenoid 222. In some embodiments, the solenoid housing 238 may extend past a bottom portion 239 of the solenoid 222 and engage the extension 226. The solenoid housing 238 may engage the extension 226 with a rotational connection, such as a bearing including a seal. In this manner, the gap 236 may extend around a portion or all of an outer surface of the solenoid 222, with the solenoid housing 238 sealing the gap to prevent the gas or fluid from escaping. In other words, the gap 236 may be a part of a solenoid chamber 240, which extends around the solenoid and the magnetic conductor 228. In other embodiments, the solenoid housing 238 may engage the solenoid 222 at any location along the outer surface of the solenoid 222.

A moving member 242 (e.g., actuating member) may be a part of an actuation valve 244. The actuation valve 244 may include a flow restrictor 246 and a flow path 248. FIG. 2-1 shows the downhole connection 212 in a first position, with the moving member 242 extended away from the solenoid 222 in a moving member first position. In the first position, the flow restrictor 246 blocks the entrance 250 to the flow path 248. In this manner, a fluid flow into the flow path 248 is reduced or stopped when the downhole connection 212 is in the first position. In some embodiments, the magnetic conductor 228 may move relative to the solenoid 222 with the moving member 242. In some embodiments, the moving member 242 and a portion of the flow restrictor shaft 246 may be contained within a pressure housing that isolates the moveable member from the pressure at the flow path 248.

In the position shown in FIG. 2-1, there is an actuator gap 241 between the magnetic conductor 228 and the moving member 242. In some embodiments, the actuator gap 241 may be in a range having an upper value and a lower value, or upper and lower values including any of 0.1 mm, 0.5 mm, 1 mm, 2 mm, 3 mm, 4 mm, 5 mm, 6 mm, 7 mm, 8 mm, 9 mm, 10 mm, or any value therebetween. For example, the actuator gap 241 may be greater than 0.1 mm. In other examples, the actuator gap 241 may be less than 10 mm. In yet other examples, the actuator gap 241 may be any value in a range between 0.1 mm and 10 mm. In at least one embodiment, it may be critical that the actuator gap 241 is between 0.1 mm and 10 mm. The actuator gap 241 may be sized such that a magnetic flux may flow through the magnetic conductor 228 and such that the magnetic conductor 228 may be magnetically attracted to the solenoid 222 when the solenoid 222 is activated.

FIG. 2-2 shows the downhole connection 212 in a second position, with the moving member 242 in the moving member second position. In the moving member second position, the moving member 242 may be located in the opening 232 such that it is closer to the solenoid 222 than in the moving member first position (i.e., closer to the extension 226 of the independently rotating platform 220, or to a downhole end 251 of the solenoid 222).

Because the magnetic conductor 228 does not move during actuation of the solenoid, the gap 236 may be remain the same or approximately the same between the magnetic conductor 228 and the solenoid 222 in the moving member second position as in the moving member first position. Thus, the magnetic conductor 228 and the solenoid 222 may not contact when the moving member 242 is in the moving member second first position or the moving member second position. In other words, the magnetic conductor 228 and the solenoid 222 may not come into physical or mechanical contact in the first position of the downhole connection 212 or the second position of the downhole connection 212. In this manner, there may always be a non-zero distance between the magnetic conductor 228 and the solenoid 222.

As previously discussed, the magnetic conductor 228 may remain fixed relative to the solenoid 222, meaning that as the solenoid 222 is activated, the magnetic conductor 228 may not move, and the gap distance 237 may be the same as the second gap distance 237-2. The moving member 242 may have a second gap between the moving member 242 and the magnetic conductor 228. The moving member 242 may be magnetically attracted to the magnetic field of the activated solenoid 222. Thus, when the solenoid 222 is activated, the moving member 242 may move toward the solenoid 222, while the magnetic conductor 228 remains at a fixed distance relative to the solenoid 222. In some embodiments, when the moving member 242 is moved toward the magnetic conductor 228, the second gap may be completely closed, or, in other words, the moving member 242 may contact the magnetic conductor 228 when the solenoid 222 is activated. In some embodiments, the moving member 242 may move approximately ⅓ or greater of a diameter of the diameter of the actuation valve 244.

As discussed above, the gap 236 may reduce the number of rotational connections between the rotating member 214 and the independently rotating member 216. This may reduce the complexity of the BHA (e.g., BHA 106 of FIG. 1), reduce wear on components of the downhole connection 212, and reduce the cost of the BHA. In some embodiments, the gap 236 may make the downhole connection 212 a frictionless or a low-friction connection because contact points between the rotating member 214 and the independently rotating member 216 are limited.

Moving the moving member 242 toward the solenoid 222 may remove the flow restrictor 246 from the entrance 250 of the flow path 248. This may allow fluid to enter the flow path 248. In this manner, the actuation valve 244 may be opened in the downhole connection 212 second position, or when the moving member 242 is in the moving member second position. Similarly, the actuation valve 244 may be closed in the downhole connection 212 first position (e.g., the position depicted in FIG. 2-1), or when the moving member 242 is in the moving member first position (as shown in FIG. 2-1).

In some embodiments, the solenoid 222 may be deactivated when the downhole connection 212 is in the first position. Thus, when the solenoid 222 is activated, the moving member 242 may be drawn toward the solenoid 222. This may remove the flow restrictor 246 from the entrance 250 of the flow path 248. In this manner, the solenoid 222 is activated when the downhole connection 212 is in the second position. Thus, activating the solenoid 222 may actuate the moving member 242, which may actuate or open the actuation valve 244.

After the solenoid 222 is deactivated, a resilient member (not shown) may provide a return force to move or urge the moving member 242 back from the moving member second position to the moving member first position. The resilient member may include a hydraulic or pneumatic piston, a coil spring, a wave spring, a Belleville washer, or the like. Therefore, by activating and deactivating the solenoid 222, the actuation valve 244 may be activated and de-activated. In this case, the standard, or unpowered, position of the downhole connection 212 may be the first position, or with the actuation valve 244 closed.

In other embodiments, the solenoid 222 may be deactivated when the downhole connection 212 is in the second position. Thus, when the solenoid 222 is activated, the moving member 242 may be repelled from the solenoid 222. This may move the moving member 242, thereby inserting the flow restrictor 246 into the entrance 250 of the flow path 248. In this manner, the solenoid 222 is activated when the downhole connection 212 is in the first position.

After the solenoid 222 is deactivated, a resilient member (not shown) may provide a return force to move or urge the moving member 242 back from the moving member first position to the moving member second position. The resilient member may include a hydraulic or pneumatic piston, a spring, a Belleville washer, or the like. Therefore, by activating and deactivating the solenoid 222, the actuation valve 244 may be activated and de-activated. In this case, the standard, or unpowered, position of the downhole connection 212 may be the second position, or with the actuation valve 244 open.

In some embodiments, hydraulic pressure from the actuation valve 244 may provide the return force to return the moving member 242 from the moving member first position to the moving member second position or from the moving member second position to the moving member first position. In this case, the magnetic field provided by the solenoid 222 attracts or repels the moving member 242 with sufficient force to overcome the hydraulic pressure.

In some embodiments, the moving member 242 may have a stroke length, which may be the difference in longitudinal length between the moving member first position and the moving member second position. In other words, the stroke length may be the difference between the actuator gap (e.g., actuator gap 241 of FIG. 2-1) and the second gap distance (e.g., no gap as shown in FIG. 2-2). In some embodiments, the stroke length may be the minimum necessary to open and close the actuation valve 244. In some embodiments, the stroke length may be in a range having an upper value and a lower value, or upper and lower values including any of 1 mm, 2 mm, 3 mm, 4 mm, 5 mm, 6 mm, 7 mm, 8 mm, 9 mm, 10 mm, 12 mm, 14 mm, 16 mm, or any value therebetween. For example, the stroke length may be greater than 3 mm. In other examples, the stroke length may be less than 20 mm. In yet other examples, stroke length may be any value in a range between 1 mm and 10 mm, or in a range between 1.5 mm and 4 mm. In some embodiments, the stroke length may be ⅓ or greater of a diameter of the actuation valve 244.

By selectively activating and deactivating the solenoid 222, the independently rotating platform 220 may communicate information from the independently rotating member 216 to the rotating member 214. This information may be encoded into a pattern represented by controlling the length of time during which the solenoid 222 is activated and deactivated, the frequency of the activations and deactivations, or any known communication pattern. As discussed above, activating and deactivating the solenoid 222 may cause the moving member 242 to move from the moving member first position to the moving member second position. In some embodiments, a sensor connected to the rotating member 214 may sense the movement of the moving member 242. A control unit, or a computing system, may then decode the information from the pattern of movement of the moving member 242. In some embodiments, a signal between the independently rotating member 216 and the rotating member 214 may be transmitted as fast as the moving member 242 may be actuated and de-actuated.

In other embodiments, the actuation valve 244 may activate a downhole tool, which may facilitate communication with other portions of the wellbore and/or the surface. For example, the downhole tool may be mud pulse telemetry system, and the actuation valve 244 may activate mud pulses in the mud pulse telemetry system. In some embodiments, sensors sensing the movement of the actuation member and the actuation valve 244 may to communicate information from the independently rotating member 216 to the rotating member 214.

Figure 3:
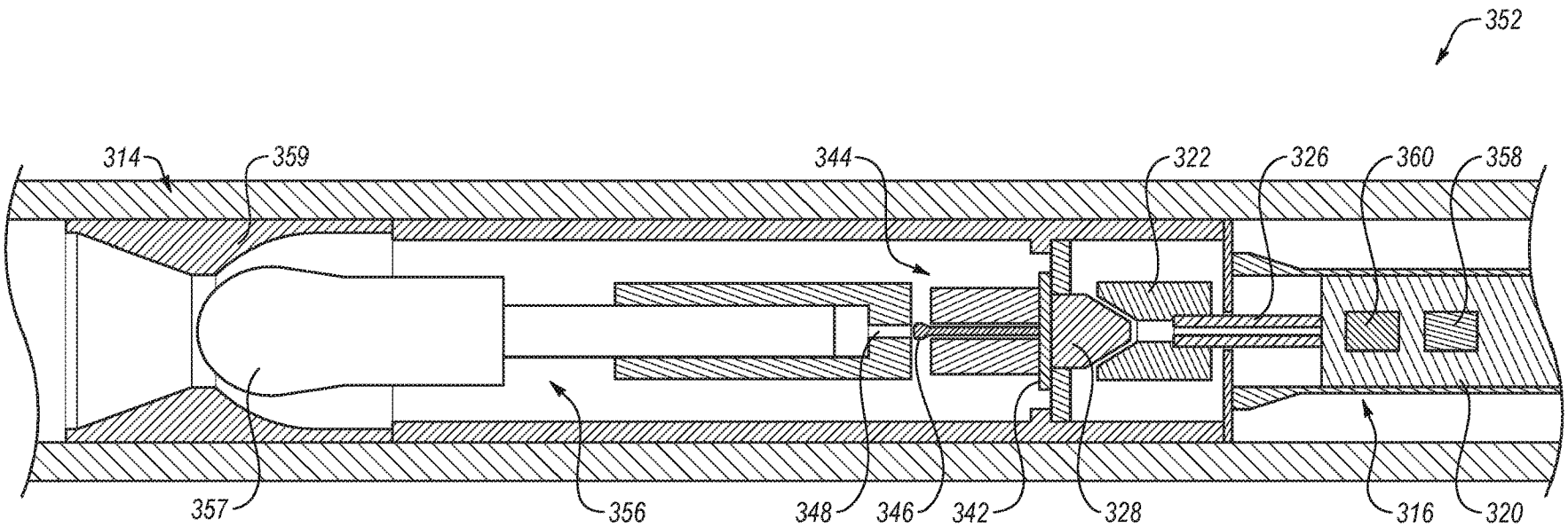
FIG. 3 is a cross-sectional view of a downhole connection, according to at least one embodiment of the present disclosure.

FIG. 3 is a representation of an embodiment of a downhole telemetry system 352. The downhole telemetry system 352 may include at least some of the same features and characteristics as the connections described in relation to FIG. 2-1 and FIG. 2-2. In some embodiments, the downhole telemetry system 352 may include a rotating member 314 and an independently rotating member 316. The independently rotating member 316 may include a roll stabilized platform 320. An extension 326 from the uphole end of the roll stabilized platform 320 may be connected to a solenoid 322. A magnetic conductor 328 may be offset from the solenoid 322. The magnetic conductor 328 may be connected to an actuation valve 344, the actuation valve 344 including a flow restrictor 346 that may restrict flow to a flow path 348 based on the position of a moving member 342.

In some embodiments, the roll stabilized platform 320 may be (or may be a part of) a measuring while drilling (MWD) tool, a logging while drilling (LWD) tool, a rotary steerable system (e.g., a rotary steerable control unit), or any combination of the foregoing. The roll stabilized platform 320 may include a platform control unit 360. The platform control unit 360 may be in electronic communication with the solenoid 322. The platform control unit 360 may control the activation of the solenoid 322. In other words, the platform control unit 360 may direct electric current to the solenoid 322 to activate or deactivate the solenoid 322.

The platform control unit 360 may encode data into a pattern. For example, the platform control unit 360 may encode data by activating and/or deactivating the solenoid 322 in the pattern. Therefore, the platform control unit 360 may communicate or transmit information by activating and/or deactivating the solenoid 322 in the pattern, the pattern including the encoded data.

As the solenoid 322 is activated and/or deactivated, the actuation valve 344 may be opened and/or closed. The flow path 348 may be in fluid communication with a mud pulse generator 356. When the actuation valve 344 is open, fluid may flow through the flow path 348, which may actuate the mud pulse generator 356. In this manner, the mud pulse generator 356 may be in communication with the roll stabilized platform 320. In other words, the roll stabilized platform 320 may communicate information to the mud pulse generator 356 by activating and/or deactivating the solenoid 322 in the pattern. This may allow the roll stabilized platform 320 to communicate information with elements of a drilling system that do not rotate at the same rate as the roll stabilized platform.

In some embodiments, a flow restrictor 357 in the mud pulse generator 356 has a high pressure position and a low pressure position. When the flow restrictor 357 is in the high pressure position, drilling fluid flowing through the mud pulse generator 356 is restricted, which increases the hydraulic pressure of the drilling fluid. When the flow restrictor 357 is in the low pressure position, drilling fluid flowing through the mud pulse generator 356 is relatively unrestricted, which decreases the hydraulic pressure of the drilling fluid. Therefore, by changing the flow restrictor 357 between the high pressure position and the low pressure position, the hydraulic pressure of the drilling fluid may be changed, which may result in a "pressure pulse." It should be understood that the mud pulse generator 356 shown in FIG. 3 is simply one sample embodiment of a mud-pulse generator. Other mud pulse generators (e.g., a siren type mud pulse generator), using flow restrictors 357 having different shapes and/or located in different positions (such as in the wall 359) may also be used in embodiments of the present disclosure.

When the actuation valve 344 is open, fluid flowing through the flow path 348 may actuate the mud pulse generator 356, changing the flow restrictor 357 from the low pressure position to the high pressure position. Similarly, when the actuation valve 344 is closed, the mud pulse generator 356 may be de-actuated, and the flow restrictor 357 may change from the high pressure position to the low pressure position. Therefore, when the solenoid 322 is activated, the mud pulse generator 356 may increase the pressure of the drilling fluid, and when the solenoid 322 is deactivated, the mud pulse generator 356 may decrease the pressure of the drilling fluid. Thus, pressure pulses may be generated by activating and deactivating the solenoid 322. Because the actuation valve 344 actuates and de-actuates the mud pulse generator 356, the actuation valve 344 may be a pilot valve for the mud pulse generator 356.

In some embodiments, the power to actuate the solenoid 322 is located on the roll stabilized platform 320. Because the actuation valve 344 may be a pilot valve for the mud pulse generator 356, the mud pulse generator 356 may not need an independent power source. Therefore, the mud pulse generator 356 may be completely mechanical, or completely hydraulically operated, without an electronic control unit. In some embodiments, the mud pulse generator 356 may have no other actuation mechanism, and may be actuated only by the actuation valve 344. In other embodiments, a sensor on the rotating member 314 may sense the actuation and de-actuation of the moving member 342, and an electronic control unit on the mud pulse generator 356 may actuate the mud pulse generator.

In this manner, the platform control unit 360 may communicate information and/or data from the independently rotating member 316 to any location that is capable of receiving and receiving pressure pulses and interpreting the encoded data. In some embodiments, the platform control unit 360 may communicate information and/or data from the independently rotating member 316 to a pressure pulse receiver located at a surface location. In the same or other embodiments, the platform control unit 360 may communicate information and/or data from the independently rotating member 316 to a pressure pulse receiver located at a downhole tool. Thus, the platform control unit 360 may communicate information over relatively short ranges (e.g., 0-50 feet) up to and including relatively long ranges (e.g., the entire length of the borehole or over 8,000 feet).

In at least one embodiment, the roll stabilized platform 320 may include at least one platform sensor 358 in electronic communication with the platform control unit 360. The at least one platform sensor 358 may be located on an MWD tool or an LWD tool, or the at least one platform sensor 358 may be located on another aspect of the roll stabilized platform. The at least one platform sensor 358 may include any type of sensor, such as a directional sensor (e.g., azimuth and/or inclination), a gravimetric sensor, a gamma ray sensor, an accelerometer, a gyroscope, a resistivity sensor, a tool status sensor, (e.g., strain gauge or resistivity array) any other sensor, or combinations thereof.

The at least one platform sensor 358 may take a measurement. The platform control unit 360 may then encode the measurement into a pattern and activate the solenoid 322 in the pattern. In this manner, the mud pulse generator 356 may transmit the measurement as pressure pulses in the pattern. Thus, the measurement may be communicated to any location that can receive and decode pressure pulses with a mud pulse receiver.

In some embodiments, the platform control unit 360 may control actuation of the mud pulse generator 356 based on a set of predetermined drilling conditions, such as wellbore depth, inclination, formation characteristics (e.g., rock type, rock hardness, and porosity), other drilling conditions, or combinations thereof. In some embodiments, the at least one platform sensor 358 may take a measurement, and, based at least in part on the measurement, the platform control unit 360 may actuate or de-actuate the actuation valve 344 and therefore the mud pulse generator 356.

Figure 4:
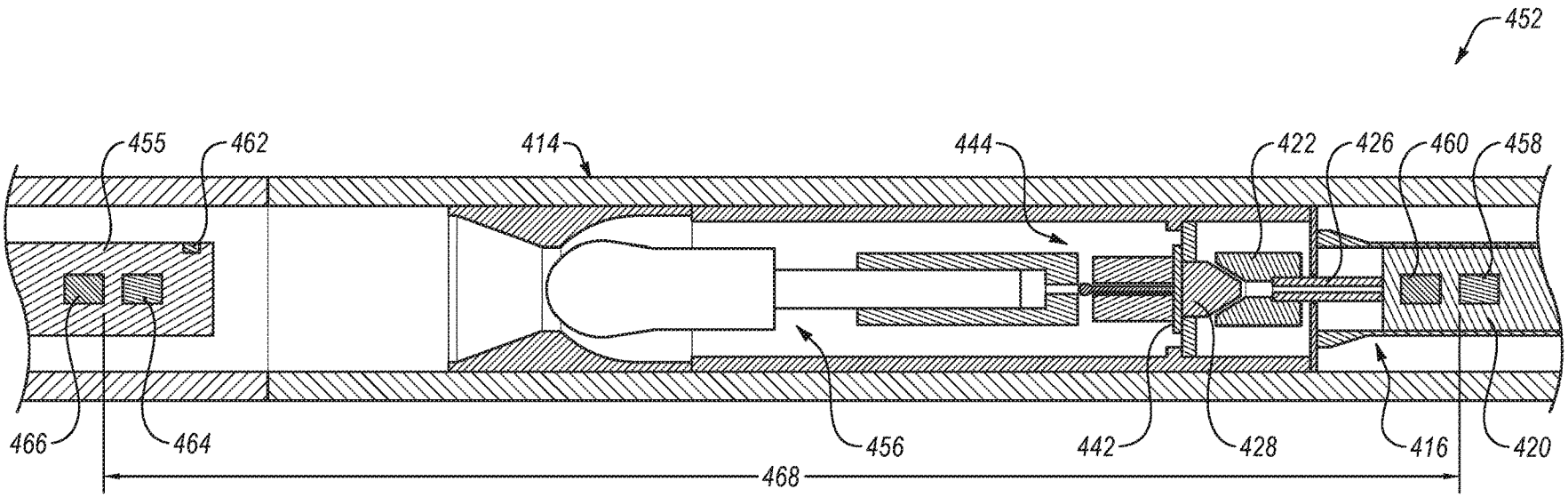
FIG. 4 is a cross-sectional view of a downhole telemetry system, according to at least one embodiment of the present disclosure.

FIG. 4 is a representation of a downhole telemetry system 452, according to at least one embodiment of the present disclosure. The downhole telemetry system 452 may include at least some of the same features and characteristics as the downhole telemetry systems and connections described in relation to FIG. 2-1 through FIG. 3. In some embodiments, the downhole telemetry system 452 may include a rotating member 414 and an independently rotating member 416. The independently rotating member 416 may include a roll stabilized platform 420. An extension 426 from the uphole end of the roll stabilized platform 420 may be connected to a solenoid 422. A magnetic conductor 428 may be offset from the solenoid 422 and a moving member 442 may be offset from the magnetic conductor 428. The magnetic conductor 428 may be connected to an actuation valve 444, the actuation valve 444 actuating a mud pulse generator 456. Therefore, the actuation valve 444 may be a pilot valve for the mud pulse generator 456. In this manner, the roll stabilized platform 420 may be in communication with the mud pulse generator 456. In other words, the roll stabilized platform 420 may activate and/or deactivate the solenoid 422 in the pattern, thereby actuating and/or de-actuating the actuation valve 444. This may allow the roll stabilized platform 420 to communicate information to the mud pulse generator 456. This may further allow the roll stabilized platform 420 to communicate information with elements of a drilling system that do not rotate at the same rate as the roll stabilized platform.

In some embodiments, a receiver 462 may be configured to detect the pressure pulses generated by the mud pulse generator 456. In some embodiments, the receiver 462 may be any sensor or tool that is capable of detecting a change in drilling pressure caused by pressure pulses, such as pressure pulses generated by the mud pulse generator 456. In at least one embodiment, the receiver 462 may be configured to detect a change in drilling pressure caused by pressure pulses propagated from a surface location. Therefore, the receiver 462 may be configured to detect any change in drilling pressure, regardless of its source.

In some embodiments, the receiver 462 may directly measure pressure of a drilling fluid with a pressure sensor, such as a piston, a diaphragm, a strain gauge, a piezoelectric pressure sensor, an optical fiber, a pressure transducer, a pressure transmitter, or any combination of the foregoing. In the same or other embodiments, the receiver 462 may indirectly measure pressure of the drilling fluid. For example, the receiver 462 may measure a property of a drilling fluid dependent on the pressure, such as volumetric flow rate or fluid velocity. In other examples, the receiver 462 may measure the rotational rate of a turbine or other rotating element whose rotation depends on the velocity and volumetric flow rate of the drilling fluid (which depend on the drilling pressure). Therefore, the receiver 462 may be any device configured to detect or measure a change in drilling fluid pressure.

In some embodiments, the receiver 462 may be located on a downhole tool 455. For example, the downhole tool 455 may be an MWD tool or an LWD tool. In other examples, the downhole tool 455 may be an expandable downhole tool, such as an underreamer, a section mill, or a stabilizer. In yet other embodiments, the downhole tool 455 may be a power generation unit, such as a mud motor or a turbine motor. In still other embodiments, the downhole tool 455 may be any tool or sub used on a BHA or in a downhole environment. In further embodiments, the multiple receivers 462 may be located on multiple components (e.g., an MWD tool, an LWD tool, an expandable downhole tool, a power generation unit, other tools and/or subs, or combinations thereof) of the downhole tool 455.

In some embodiments, the downhole telemetry system 452 may be located immediately downhole of the downhole tool 455. In other words, the downhole tool 455 may be directly connected to the downhole telemetry system 452 via a mechanical connection, such as a standard threaded pipe connection. In other embodiments, the downhole tool 455 may be located further away from the downhole telemetry system 452. For example, the downhole tool 455 may be one of a plurality of downhole tools, and one or more other downhole tools of the plurality of downhole tools may be located between the downhole tool 455 and the downhole telemetry system 452. In the same or other examples, one or more tubular members may be located between the downhole tool 455 and the downhole telemetry system 452.

The downhole tool 455 may include a downhole tool control unit 464. The downhole tool control unit 464 may be in electronic communication with the receiver 462. In other words, the receiver 462 may transmit the pressure measurements (or associated measurements) to the downhole tool control unit 464. The downhole tool control unit 464 may identify the pattern of the pressure pulses. After identifying the pattern of the pressure pulses, the downhole tool control unit 464 may decode the information or the data from the pattern. In this manner, the downhole telemetry system 452 may communicate information from the roll stabilized platform 420 to the downhole tool 455. Therefore, the information from the roll stabilized platform 420 may be communicated to any downhole tool 455 that includes a receiver 462.

In some embodiments, the downhole tool control unit 464 may process the information decoded from the pressure pulses received by the receiver 462. For example, the information may be a platform measurement measured by a platform sensor 458. A platform control unit 460 may encode the platform measurement into a pattern, and the platform control unit 460 may activate and deactivate the solenoid 422 in the pattern, which may actuate the mud pulse generator 456 in the pattern. Thus, the pattern received by the receiver 462 and decoded by the downhole tool control unit 464 may be the platform measurement. In some embodiments, the platform sensor 458 may be any sensor used in downhole tools. For example, the platform sensor 458 may be a trajectory sensor (azimuth and/or inclination), a gamma sensor, a resistivity sensor, a tool status sensor (e.g., vibration, strain gauge, temperature), or any other type of sensor.

The downhole tool control unit 464 may then process the platform measurement. For example, the downhole tool control unit 464 may compare the platform measurement to a tool measurement taken by a downhole tool sensor 466. In some embodiments, the platform measurement and the tool measurement may be different measurements. In other embodiments, the platform measurement and the tool measurement may be similar measurements. For example, the platform measurement and the tool measurement may both be trajectory measurements (azimuth and/or inclination). In other examples, the platform measurement and the tool measurement may both be resistivity measurements.

The roll stabilized platform 420 may be located closer to the bit than the downhole tool 455. Therefore, the platform sensor 458 may be closer to the bit than the downhole tool sensor 466. Measurements taken closer to the bit may be more accurate, or at least more representative of conditions at the bit, than measurements taken further away from the bit. Therefore, a difference in conditions between the platform sensor 458 and the downhole tool sensor 466 may be analyzed. In some embodiments, this difference in conditions may provide the downhole tool control unit 464, or an operator at the surface, with an indication of how fast drilling conditions are changing. For example, a difference in gamma measurements may indicate if the formation has changed, or if the bit is wandering out of a target formation. In other examples, a difference in resistivity may indicate a change in downhole fluid properties, such as if a downhole water or oil reservoir is encountered. In still other examples, a difference in vibration of different locations of a BHA may indicate how a BHA is performing, and provide feedback that may be used during the design of other BHAs.

A sensor distance 468 may be the distance between the platform sensor 458 and the downhole tool sensor 466. The downhole tool control unit 464 may use the sensor distance 468 to analyze the platform measurement. For example, a platform measurement measuring trajectory (azimuth and/or inclination) may be compared to tool measurement measuring trajectory (azimuth and/or inclination). A trajectory difference over the sensor distance 468 may be used to determine the immediate or real-time curvature of the borehole. This curvature information may help prevent the need to wait for the downhole tool sensor 466 to travel the sensor distance 468. Therefore, the downhole tool control unit 464 and/or an operator may have more current or up-to-date information based at least in part on the information from the platform sensor 458.

In some embodiments, the downhole tool control unit 464 may change one or more drilling parameters based on the platform measurement. For example, if the platform measurement indicates that the bit has reached a target depth or a target formation, then the downhole tool control unit 464 may signal for an expandable tool, such as a section mill or an underreamer, to expand. In other examples, if the platform measurement indicates that the bit is vibrating excessively or experiencing a greater weight on bit than is desired, the downhole tool control unit 464 may send a signal indicating that the rotational rate or the weight on bit should be reduced. In still other examples, if the platform measurement indicates that the bit has wandered off a planned trajectory, the downhole tool control unit 464 may signal for a rotary steerable system to change the trajectory of the drill bit. In yet other examples, the downhole tool 455 may be an expandable tool, and the downhole tool control unit 464 may modify an extension of the expandable blades based at least in part on the information decoded from the pressure pulses.

Figure 5:
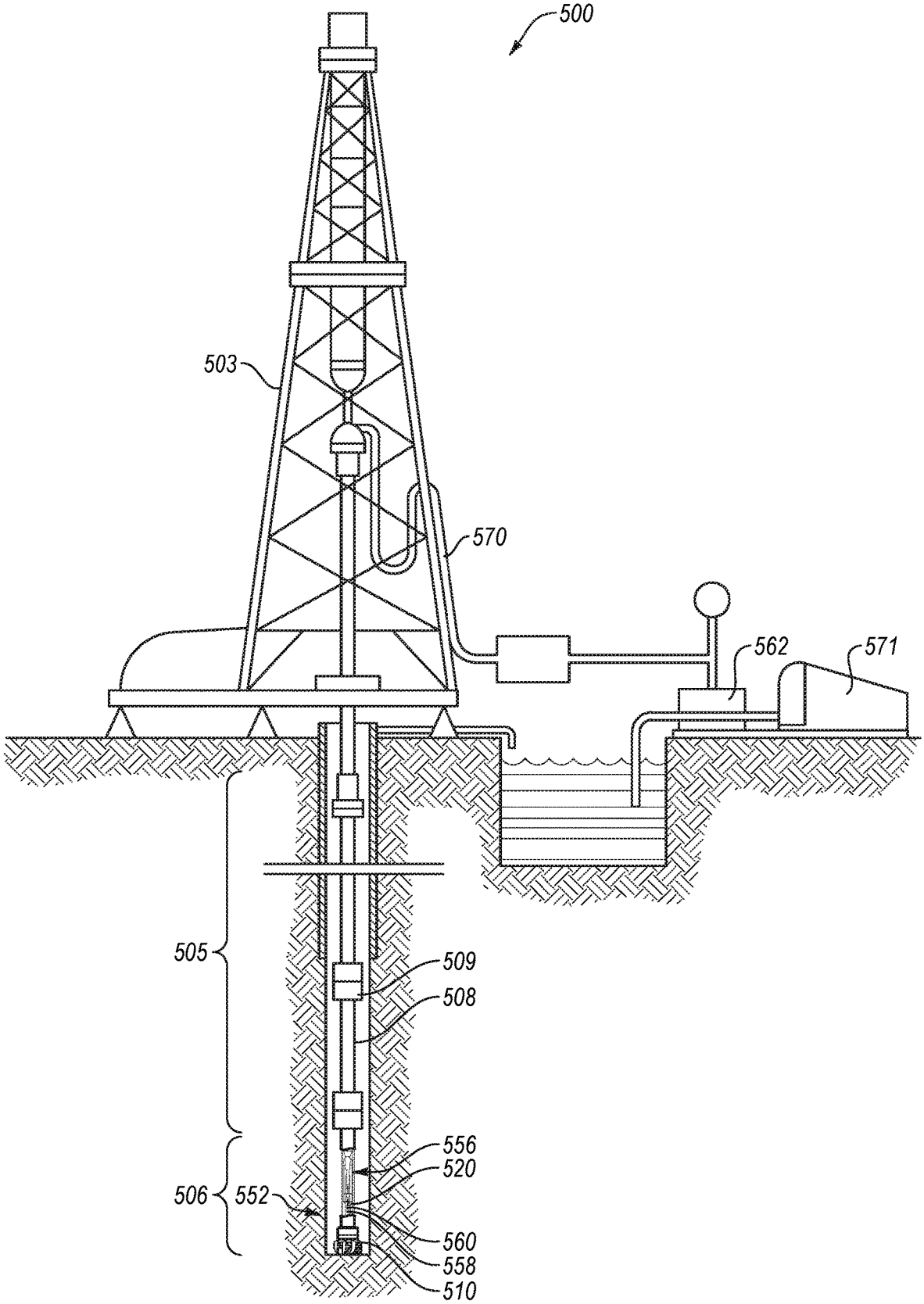
FIG. 5 is a cross-sectional view of another downhole telemetry system, according to at least one embodiment of the present disclosure.

FIG. 5 is a representation of a drilling system 500, according to at least one embodiment of the present disclosure. The drilling system 500 may include at least some of the same features and characteristics as the downhole telemetry systems and connections described in relation to FIG. 2-1 through FIG. 4. The drilling system 500 may include a drill rig 503 located at a surface location that operate a BHA 506 connected to the downhole end of a drill string 505.

The drill string 505 may include several joints of pipe 508 connected end-to-end through tool joints 509. The BHA 506 may include the bit 510 or other components. Examples of additional BHA components include drill collars, stabilizers, MWD tools, LWD tools, downhole motors, underreamers, section mills, hydraulic disconnects, jars, vibration or dampening tools, other components, or combinations of the foregoing.

The BHA 506 may include a mud pulse telemetry system 552. The mud pulse telemetry system 552 may include a roll stabilized platform 520 above the bit 510. The roll stabilized platform 520 may include a platform sensor 560. The roll stabilized platform 520 may rotate at a different rotational rate than the rest of the BHA 506, including the bit 510. For example, the roll stabilized platform 520 may be a roll stabilized rotary steerable system. The roll stabilized platform 520 may include a solenoid that may cause a moving member to actuate a mud pulse generator 556 adjacent to the roll stabilized platform 520. Actuating the mud pulse generator 556 may cause a change in pressure of drilling fluid flowing through the BHA 506 and the drill string 505. In this manner, pressure pulses in the drilling fluid may be generated, activated by the roll stabilized platform 520 and actuated by the mud pulse generator 556.

As discussed above, the pressure pulses may be generated in a pattern that includes encoded data. The encoded data may include measurements taken at the sensor 558, or any other data.

The pressure pulses may be transmitted through the drilling fluid to the surface. The pressure pulses may be transmitted to a stand pipe 570. The stand pipe 570 may refer generally to the pipes leading from a drilling fluid pump 571 to the drill string 505 at the drill rig 503. The pressure in the stand pipe 570 may be measured at a receiver 562. The receiver 562 may be any receiver known in the art used to measure fluid pressure. The receiver 562 may include a processor that decodes the pattern and retrieves the information from the pattern in the pressure pulses. In this manner, information may be communicated from the roll stabilized platform 520 to the surface. In other words, information may be communicated from the roll stabilized platform 520 to a receiver 562, the receiver 562 being a surface receiver.

As discussed above, measurements taken closer to the bit 510, such as at the sensor 558 on the roll stabilized platform 520, may be more accurate or more representative of current drilling conditions than measurements taken further from the bit 510. Therefore, communicating information from the roll stabilized platform 520 to the surface may provide an operator with more accurate and/or representative information. The operator may make changes in response to the data or information decoded from the pressure pulses. More accurate and/or representative information may allow the operator to make those changes sooner, or to make changes more specifically suited to measured drilling conditions. This may provide many benefits, including, but not limited to, improving the rate of penetration, reducing the cost of the borehole, lengthening equipment life, improving well production, or any combination of the foregoing.

Figure 6:
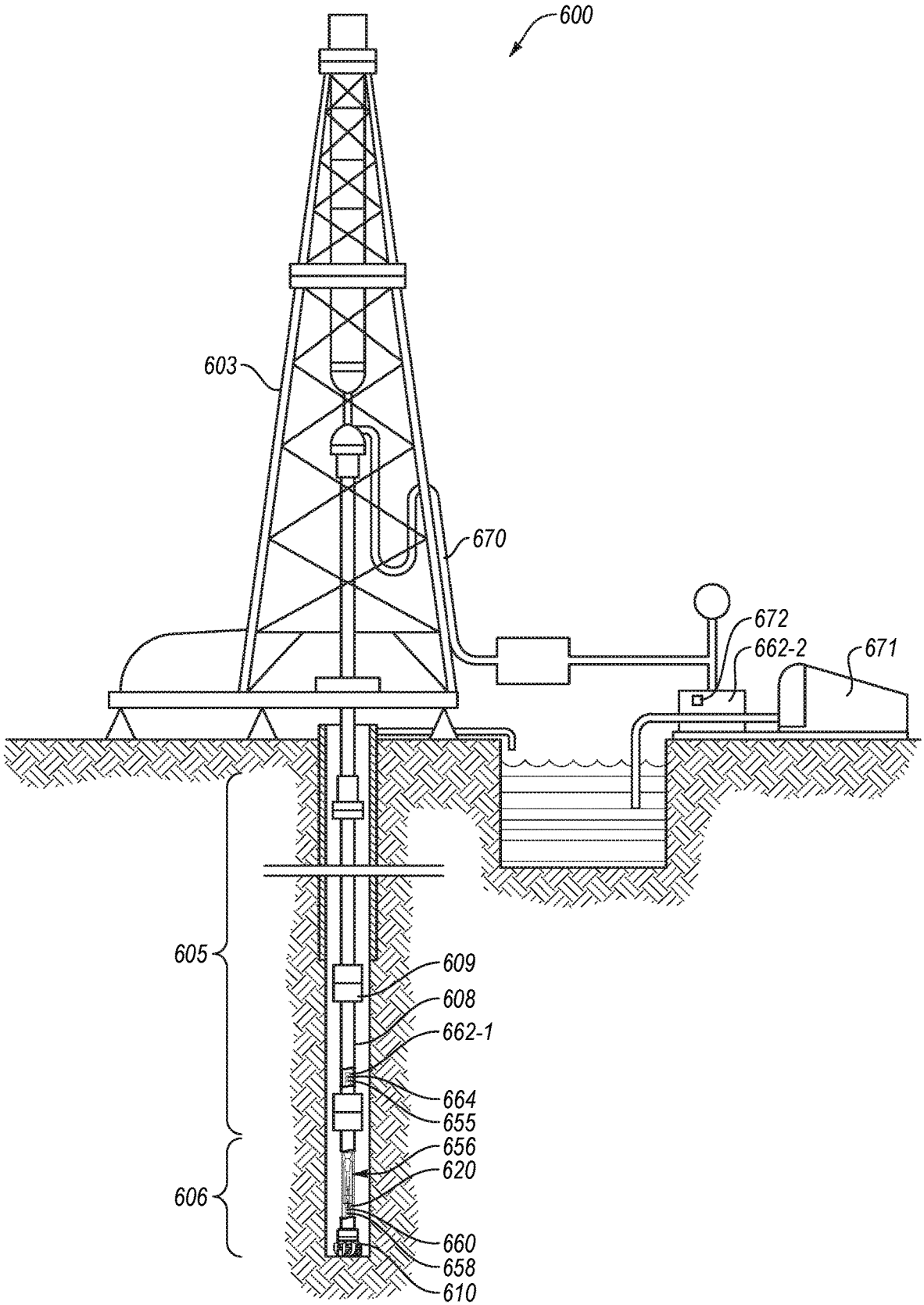
FIG. 6 is a cross-sectional view of yet another downhole telemetry system, according to at least one embodiment of the present disclosure.

FIG. 6 is a representation of a drilling system 600, according to at least one embodiment of the present disclosure. The drilling system 600 may include at least some of the same features and characteristics as the drilling systems, downhole telemetry systems and connections described in relation to FIG. 2-1 through FIG. 5. The drilling system 600 may include a drill rig 603 located at a surface location that operate a BHA 606 connected to the downhole end of a drill string 605.

The drill string 605 may include several joints of pipe 608 connected end-to-end through tool joints 609. The BHA 606 may include the bit 610 or other components. Examples of additional BHA components include drill collars, stabilizers, MWD tools, LWD tools, downhole motors, underreamers, section mills, hydraulic disconnects, jars, vibration or dampening tools, other components, or combinations of the foregoing.

The BHA 606 may include a mud pulse telemetry system. The mud pulse telemetry system may include a roll stabilized platform 620 above the bit 610. The roll stabilized platform 620 may include a platform sensor 658. The roll stabilized platform 620 may rotate at a different rotational rate than the rest of the BHA 606, including the bit 610. For example, the roll stabilized platform 620 may be a roll stabilized rotary steerable system. The roll stabilized platform 620 may include a solenoid that may cause a moving member to actuate a mud pulse generator 656 adjacent to the roll stabilized platform 620. Actuating the mud pulse generator 656 may cause a change in pressure of drilling fluid flowing through the BHA 606 and the drill string 605. In this manner, pressure pulses in the drilling fluid may be generated, activated by the roll stabilized platform 620 and actuated by the mud pulse generator 656.

As discussed above, the pressure pulses may be generated in a pattern that includes encoded data. The encoded data may include measurements taken at the platform sensor 658, or any other data.

The drilling system 600 may further include a downhole tool 655. The downhole tool may be located on the BHA 606, or uphole of the BHA 606 in the drill string 605. The downhole tool 655 may include a downhole tool receiver 662-1, the downhole tool receiver 662-1 being configured to receive the pressure pulses. A downhole tool control unit 664 may decode the pattern of the pressure pulses, thereby receiving the encoded information or data communicated from the roll stabilized platform 620. In this manner, the roll stabilized platform 620 may communicate information to a downhole tool 655.

Furthermore, the pressure pulses may be transmitted through the drilling fluid to the surface. The pressure pulses may be transmitted to a stand pipe 670. The stand pipe 670 may refer generally to the pipes leading from a drilling fluid pump 671 to the drill string 605 at the drill rig 603. The pressure in the stand pipe 670 may be measured at a surface receiver 662-2. The surface receiver 662-2 may be any receiver known in the art used to measure fluid pressure. A processor in electronic communication with the surface receiver 662-2 may decode the pattern and retrieve the information from the pattern in the pressure pulses. Therefore, in some embodiments, both the downhole tool receiver 662-1 and the surface receiver 662-2 may receive the pressure pulses, and decode the pattern to receive the information encoded in the pattern.

In other embodiments, only one of the downhole tool receiver 662-1 or the surface receiver 662-2 may decode the information encoded in the pattern. For example, the pressure pulses may include a leading pattern at the beginning of the pattern. The leading pattern may indicate that the pressure pulses originated from the roll stabilized platform 620. The downhole tool control unit 664 or a surface control unit 672 may decode the leading pattern. Instructions in the downhole tool control unit 664 or the surface control unit 672 may indicate that the remainder of the pattern should be disregarded, so that the downhole tool control unit 664 or the surface control unit 672 do not decode the remainder of the pattern.

In at least one embodiment, the downhole tool 655 may include a downhole tool mud pulse telemetry system. The downhole tool mud pulse telemetry system may be capable of generating pressure pulses to transmit to the surface. In some embodiments, the downhole tool 655 may operate the mud pulse generator 656 independent of the roll stabilized platform 620.

After receipt of pressure pulses (e.g., from the roll stabilized platform 620), the downhole tool 655 may process the information from the roll stabilized platform 620 with the downhole tool control unit 664. For example, the roll stabilized platform 620 may measure a measurement with the platform sensor 658, encode it into a pattern with the platform control unit 660, and actuate the mud pulse generator 656 in the pattern. The downhole tool receiver 662-1 may receive the pulse pattern and the downhole tool control unit 664 may decode the pattern, thereby retrieving the measurement from the platform sensor 658. The downhole tool control unit 664 may then process the measurement, and combine the measurement with other information and instruct a mud pulse generator to send the information to the surface. Therefore, downhole tool 655 may relay information from the roll stabilized platform 620 to the surface receiver 662-2.

Figure 7:
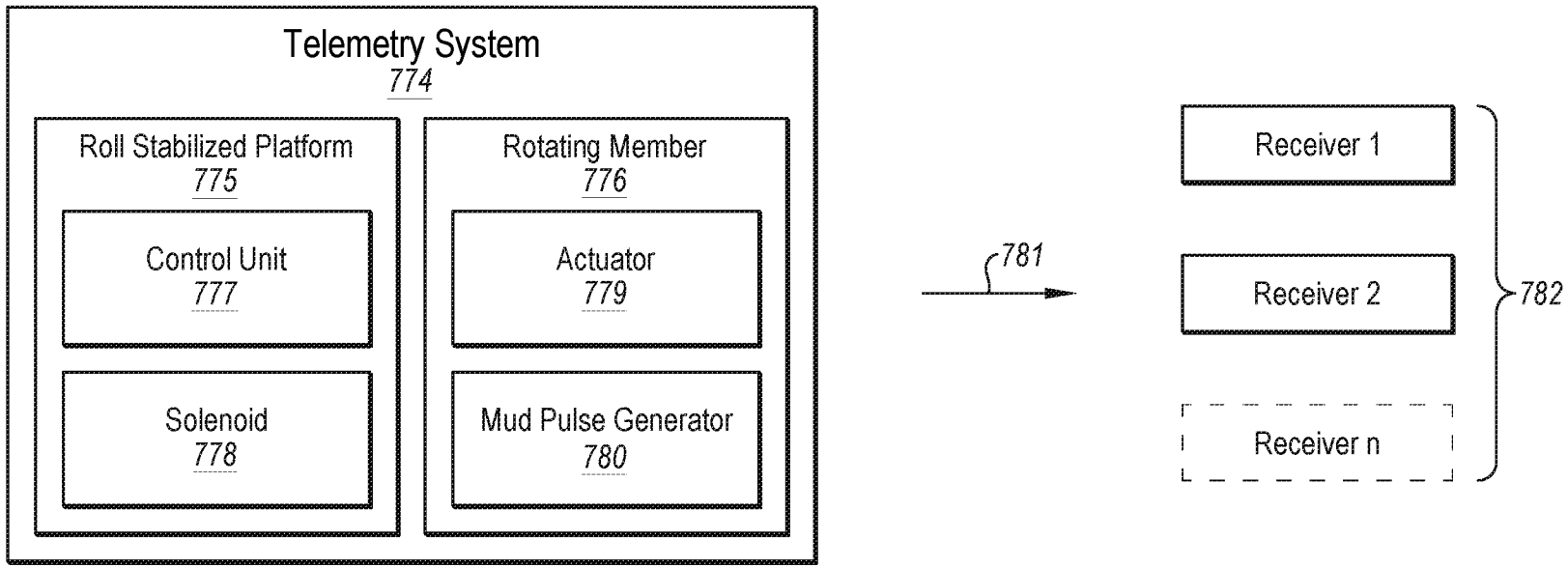
FIG. 7 is a schematic of a communication system, according to at least one embodiment of the present disclosure.

FIG. 7 is a representation of a communication system 773, according to at least one embodiment of the present disclosure. The communication system 773 may include at least some of the same features and characteristics as the drilling systems, downhole telemetry systems and connections described in relation to FIG. 2-1 through FIG. 6. The communication system 773 may include a downhole mud pulse telemetry system 774, including a roll stabilized platform 775 and a rotating member 776. The roll stabilized platform 775 may include a platform control unit 777 and a solenoid 778. The rotating member may include an actuator 779 and a mud pulse generator 780.

The platform control unit 777 may activate the solenoid 778, which may actuate the actuator 779. The solenoid 778 and the actuator 779 may be rotating at different rotational rates. Thus, the mud pulse telemetry system 774 allows for communication between elements that rotate at different rotational rates. The actuator 779 may actuate a mud pulse generator 780. The mud pulse generator 780 may generate a pressure pulse in a drilling fluid every time the actuator is activated. The platform control unit 777 may activate the solenoid 778 in a pattern, the pattern including encoded data 781. Therefore, the mud pulse generator 780 may communicate encoded data 781 based on the activation of the solenoid 778.

The encoded data 781 may be distributed or communicated to one or more receivers 782. For example, the communication system 773 may include 1, 2, 3, 4, 5, 6, 7, 8, 9, 10, or more (i.e., "n") receivers. The one or more receivers 782 may be located at any location that is capable of receiving the pressure pulses including the encoded data 781. For example, a first receiver may be located at a location along the drill string, such as at an MWD or an LWD. A second receiver may be located at a second location along the drill string, such as at a downhole tool. A third receiver may be located at a surface location, such as at a stand pipe. In other examples, a single receiver 782 may be located on a downhole tool or at a surface location.

Figure 8:
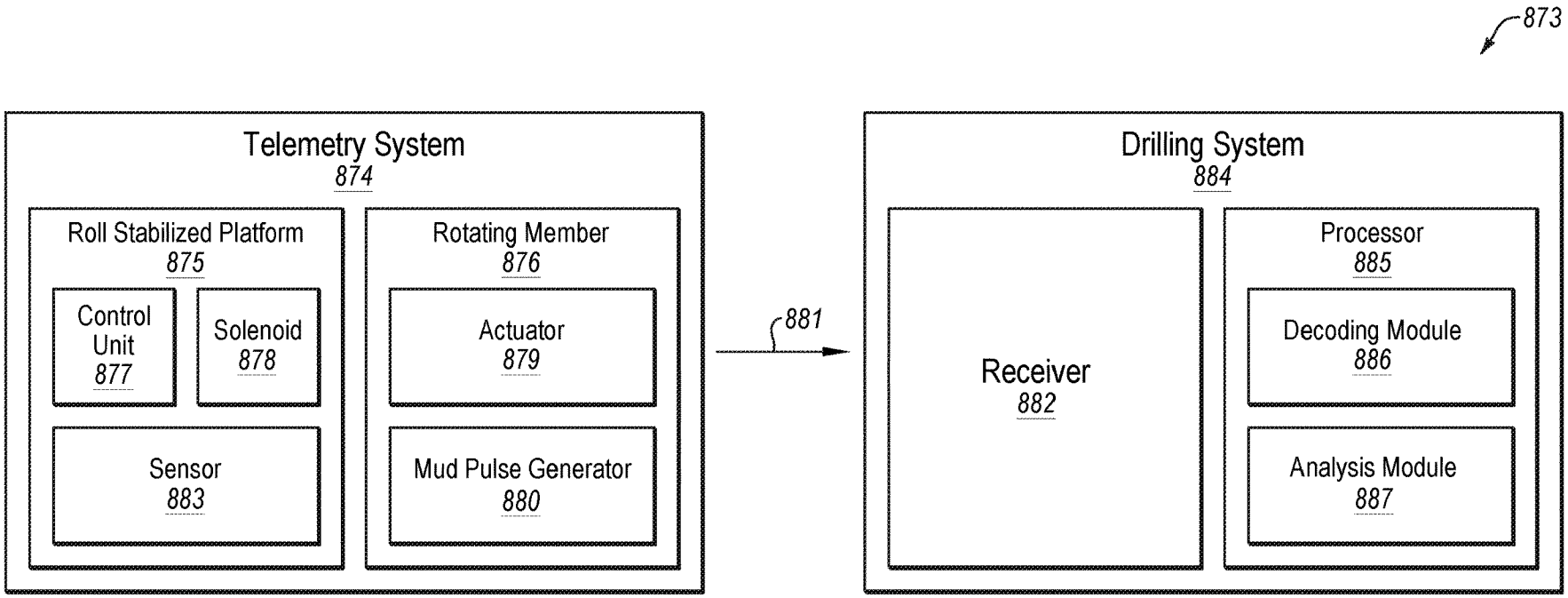
FIG. 8 is a schematic of another communication system, according to at least one embodiment of the present disclosure.

FIG. 8 is a representation of a communication system 873, according to at least one embodiment of the present disclosure. The communication system 873 may include at least some of the same features and characteristics as the drilling systems, downhole telemetry systems and connections described in relation to FIG. 2-1 through FIG. 7. In the embodiment shown, the roll stabilized platform 875 may include one or more sensors 883. The one or more sensors 883 may measure a measurement. The platform control unit 877 may encode the measurement into a pattern and activate the solenoid 878 in the pattern. The solenoid 878 may then actuate the actuator 879 and therefore the mud pulse generator 880 in the pattern. In this manner, the mud pulse telemetry system 874 may communicate encoded data 881 measured on a roll stabilized platform 875 to a rotating member 876.

The encoded data 881 may be transmitted as pressure pulses to a drilling system 884. A receiver 882 may receive the pressure pulses. A processor 885 in electronic communication with the receiver 882 may decode the encoded data 881 using a decoding module 886. The decoding module 886 may decode the encoded data 881 using any technique used for decoding encoded pressure pulses. The processor may include an analysis module 887 which may then analyze the decoded measurement.

In some embodiments, the processor 885 may change a drilling parameter of a downhole tool based on the encoded data 881. For example, the downhole tool may be an expandable downhole tool, and the processor 885 may instruct the downhole tool to expand or retract expandable blades of the expandable tool based at least in part on the encoded data 881. The extent of the expansion or retraction of expandable blades may be changed based at least in part on the encoded data 881. For example, the formation information may include an indication of the hardness of the formation. A harder formation may require stabilizer blades to be expanded further, or for a greater force used in expansion of the stabilizer blades, to adequately stabilize the BHA. Therefore, in some embodiments, the processor 885 may instruct a stabilizer to increase the force of expansion of the stabilizer blades. In other examples, the processor 885 may instruct a tool sensor to take a tool measurement based on an analysis of the encoded data 881.

In some embodiments, the encoded data 881 may include instructions for a downhole tool. The instructions may be instructions to change at least one drilling parameter of a downhole tool. For example, the instructions may be instructions for an MWD or an LWD to take a measurement. In other examples, the instructions may instruct the downhole tool to expand expandable blades. In still other examples, the instructions may instruct any downhole tool to change any drilling parameter.

In some embodiments, the drilling system 884 may be any aspect of a downhole drilling system (e.g., drilling system 100 of FIG. 1). For example, the receiver 882 may be located at a surface location, such as at a standpipe. In other examples, the receiver 882 may be located at a downhole location, such as at an MWD, an expandable tool, or other downhole tool. In some embodiments, the receiver 882 and the processor 885 may be located in different locations. For example, the receiver 882 may be located at a standpipe at the surface, but the processor 885 may be located at an operator's workstation, with the processor 885 in wired or wireless communication with the receiver 882. In other examples, the receiver 882 may be located on a first downhole tool and the processor 885 may be located on a second downhole tool, the first and second downhole tools being in electronic communication. In still other examples, the receiver 882 may be located at a downhole location and the processor 885 may be located at the surface.

Figure 9:
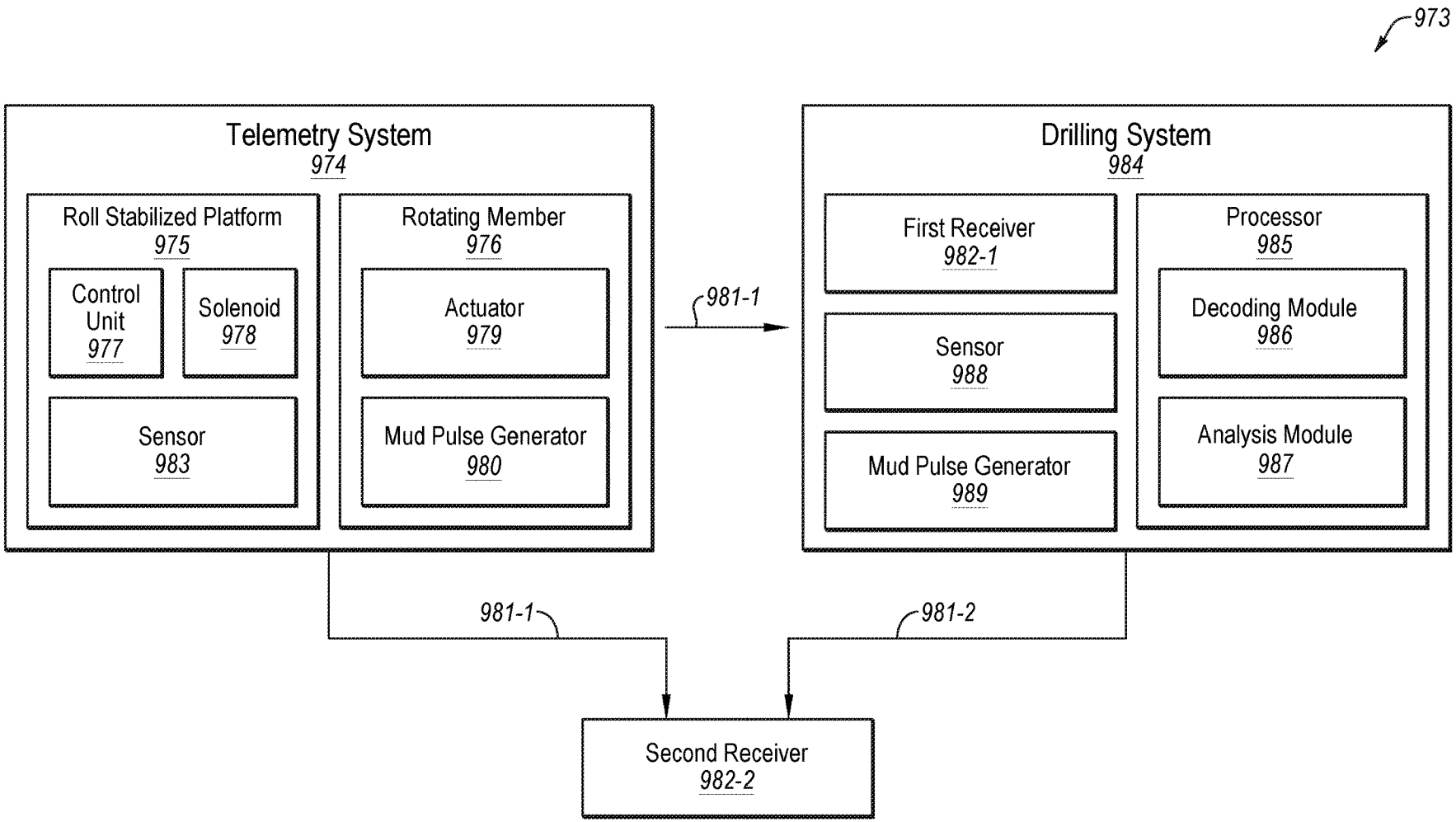
FIG. 9 is a schematic of yet another communication system, according to at least one embodiment of the present disclosure.

FIG. 9 is a representation of a communication system 973, according to at least one embodiment of the present disclosure. The communication system 973 may include at least some of the same features and characteristics as the drilling systems, downhole telemetry systems and connections described in relation to FIG. 2-1 through FIG. 8. The mud pulse telemetry system 974 may communicate information from the roll stabilized platform 975 to the rotating member 976 by using a control unit 977 to activate the solenoid 978, which actuates the actuator 979. This may cause the mud pulse generator 980 to generate a series of pressure pulses in a drilling fluid. The pressure pulses may propagate through the drilling fluid everywhere the drilling fluid is present. The pressure pulses may include a first set of encoded data 981-1, such as a platform measurement from the platform sensor 983.

A drilling system 984 may receive the pressure pulses at a first receiver 982-1. In some embodiments, the first receiver 982-1 may be located on a downhole tool, such as an MWD, an expandable tool, or another downhole tool. The drilling system 984 may include a processor 985 that may decode the first set of encoded data 981-1 using a decoding module 986. The decoded data may be analyzed with the analysis module 987.

The drilling system 984 may further include a tool sensor 988. The tool sensor 988 may collect tool measurements and communicate them to the processor 985. The tool measurements may be the same, complementary, or different measurements than the platform measurements from the platform sensor 983. The analysis module 987 of the processor may analyze the tool measurements. In some embodiments, the tool measurements may be analyzed simultaneously with, combined with, or compared to the platform measurements. In other embodiments, the tool measurements may be analyzed independently of the platform measurements.

The drilling system 984 may further include a drilling system mud pulse generator 989. In some embodiments, the drilling system mud pulse generator 989 may be the same as the mud pulse generator 980 on the rotating member 976, and the processor 985 may have independent control over the mud pulse generator 989 and in some embodiments may also have independent control over the mud pulse generator 980. In other embodiments, the drilling system mud pulse generator 989 may be different from the mud pulse generator 980 on the rotating member 976. The processor 985 may actuate the drilling system mud pulse generator 989 in a pattern encoding a second set of encoded data 981-2.

In some embodiments, the second set of encoded data 981-2 may include data decoded from the first set of encoded data 981-1. For example, the second set of encoded data 981-2 may include the platform measurement, a summary of several platform measurements, an analysis of the platform measurement, or a comparison of the platform measurement with the tool measurement, or any combination of the foregoing. In other embodiments, the second set of encoded data 981-2 may include other information, such as the tool measurement. In still other embodiments, the second set of encoded data 981-2 may include a combination of data decoded from the first set of encoded data 981-1 and other information, such as analysis by the analysis module 987, the tool measurement, or any combination of the foregoing.

The communication system 973 may further include a second receiver 982-2. The second receiver 982-2 may be located at a different location than the first receiver 982-1. For example, the first receiver 982-1 may be located on a downhole tool, and the second receiver 982-2 may be located at a surface location. In some embodiments, pressure pulses including the first set of encoded data 981-1 may be received at both the first receiver 982-1 and the second receiver 982-2. Furthermore, the pressure pulses including the second set of encoded data 981-2 may be received at the second receiver 982-2. In this manner, both the mud pulse telemetry system 974 and the drilling system 984 may independently communicate with the surface (via the second receiver 982-2). In other embodiments, the first receiver 982-1 and the second receiver 982-2 may both be located at a surface location, or may both be surface receivers.

In some embodiments, the mud pulse telemetry system 974 and the drilling system 984 may generate pressure pulses at the same frequency. In other words, the first set of encoded data 981-1 may be encoded and transmitted as a first set of pressure pulses in a first pattern having a first frequency, and the second set of encoded data 981-2 is encoded and transmitted as a second set of pressure pulses in a second pattern having a second frequency, the first frequency and the second frequency being the same. If the first and the second frequency are the same, then the first set of pressure pulses and the second set of pressure pulses may not be transmitted at the same time without loss of information. In other words, some or all of the first set of encoded data 981-1 may be lost in the second set of encoded data 981-2, some or all of the second set of encoded data 981-2 may be lost in the first set of encoded data 981-1, or some or all of both the first set of encoded data 981-1 and the second set of encoded data 981-2 may be lost in each other's signals. In other words, the first set of pressure pulses may not overlap the second set of pressure pulses without loss of data.

To prevent overlap of the first set of pressure pulses with the second set of pressure pulses, the drilling system 984 may wait for an end of the first set of pressure pulses before beginning to generate or transmit the second set of pressure pulses. In some embodiments, the drilling system 984 may wait for a gap in the first set of pressure pulses before beginning to generate or transmit the second set of pressure pulses. For example, the drilling system 984 may wait for a gap in pressure pulses of a predetermined length. After the gap in pressure pulses has extended for the predetermined length, the drilling system may determine that the first set of pressure pulses has ended, and begin generating or transmitting the second set of pressure pulses. In some embodiments, the drilling system 984 may begin the second set of pressure pulses with an identifying pattern, indicating that the drilling system 984 is generating the pressure pulses.

In some embodiments, the drilling system 984 may wait for an "end-code" at the end of the first set of pressure pulses. The end-code may also be called a "handshake." An end-code may be a unique pattern of pressure pulses that signals an end to the transmission of the first set of encoded data 981-1. When the decoding module 986 decodes the end-code, the analysis module 987 may interpret the end-code to determine that the first set of pressure pulses has been completely transmitted, or that all of the first set of encoded data 981-1 has been received. The processor 985 may then actuate the drilling system mud pulse generator 989 in the second pattern. In this manner, the processor 985 may reduce or prevent overlap between the first set of pressure pulses and the second set of pressure pulses.

It should be understood that while embodiments of the system have been described as having a receiver on the drilling system 984, each of the above embodiments could include a telemetry system 974 (e.g., the roll stabilized platform described above) also having a receiver (or the telemetry system 974 could have a receiver instead of the drilling system 984). In such embodiments, the roll stabilized platform 975 could include a receiver that listens for mud pulses or otherwise senses changes in flow from the drilling system 984 mud pulse generator 989. Those signals could be decoded and used as described above with respect to receivers. In addition, the telemetry system 974 receiver could wait for a gap, listen for an end-code or handshake, as described above, and then could transmit mud pulses using mud pulse generator 980 so as to prevent overlap of mud pulse signals. As such, the telemetry system 974 and the drilling system 984 could both receive and transmit signals and could communicate cooperatively to prevent overlap of signals that would prevent the loss of signal.

In some embodiments, the mud pulse telemetry system 974 and the drilling system 984 may generate pressure pulses at different frequencies. In other words, the first frequency may be different from the second frequency. In some embodiments, the first set of pressure pulses may have a higher frequency than the second set of pressure pulses. In other embodiments, the second set of pressure pulses may have a lower frequency than the first set of pressure pulses. In this manner, the mud pulse telemetry system 974 may transmit the first set of encoded data 981-1 at the same time that the drilling system 984 transmits the second set of encoded data 981-2. In other words, generating the first set of pressure pulses may overlap in time generating the second set of pressure pulses.

The second receiver 982-2 may receive the overlapping (or simultaneously transmitted) first set of pressure pulses and second set of pressure pulses. A processor (not shown) in electronic communication with the second receiver 982-2 may then decode the first set of encoded data 981-1 and the second set of encoded data 981-2. In some embodiments, the drilling system 984 may receive the first set of encoded data 981-1 at the same time that it is generating or transmitting the second set of encoded data 981-2.

Figure 10:
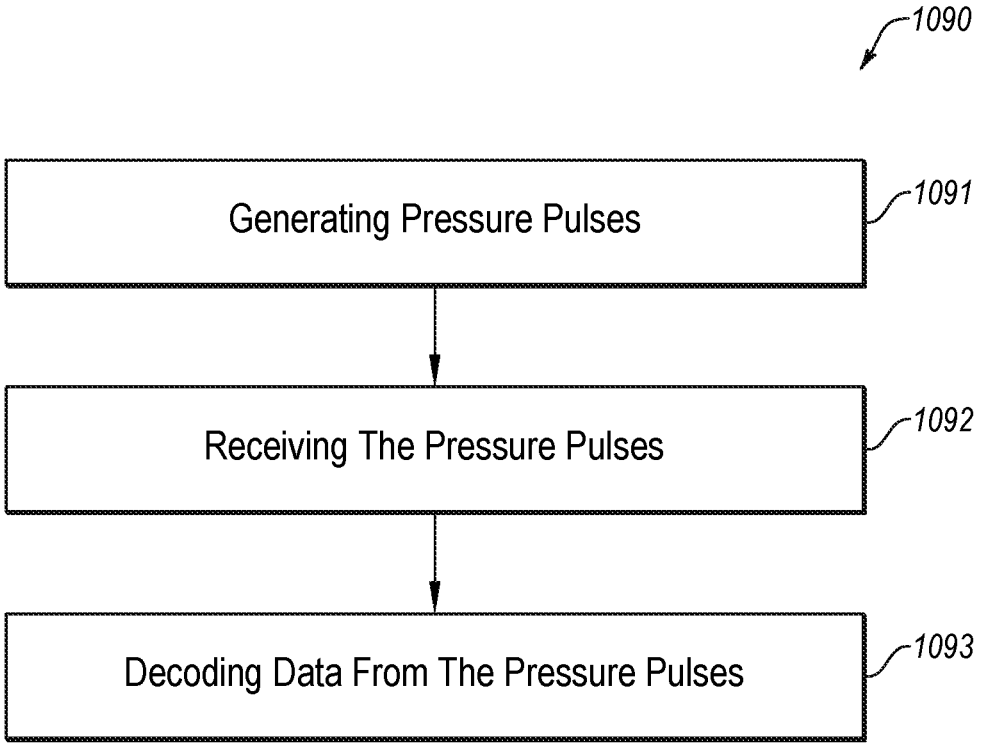
FIG. 10 is a method chart of a method for downhole communication, according to at least one embodiment of the present disclosure.

FIG. 10 is a method chart representing a method 1090 for downhole communication. The method may include generating pressure pulses in a pattern using a mud pulse generator in communication with a roll stabilized platform at 1091. The mud pulse generator may be in communication with the roll stabilized platform by a downhole connection. The downhole connection may include a solenoid on the roll stabilized platform. Activating and deactivating the solenoid may actuate and de-actuate an actuation valve for the mud pulse generator. By activating and/or deactivating the solenoid in a pattern, the roll stabilized platform may communicate information to the mud pulse generator. The pattern may include encoded data, such as a measurement or instructions to change a drilling parameter of a downhole tool. The pressure pulses may be generated by actuating the pressure pulse generator using a solenoid on the roll stabilized platform that moves an actuator on a rotating platform. The method 1090 may further include measuring a measurement at the roll stabilized platform with a sensor, the encoded data including the measurement.

The pressure pulses may be received at a receiver at 1092. The pressure pulses may be received at a surface location or at a downhole tool. The encoded data may then be decoded from the pattern at 1093. A processor in electronic communication with the receiver may perform the decoding. The decoded information may include instructions, and the processor may execute the instructions. For example, the processor may change a drilling parameter of a downhole tool based on the instructions in the decoded data. In other examples, the processor may instruct a sensor to take a measurement based on the decoded data or instructions included in the encoded data.

Figure 11:
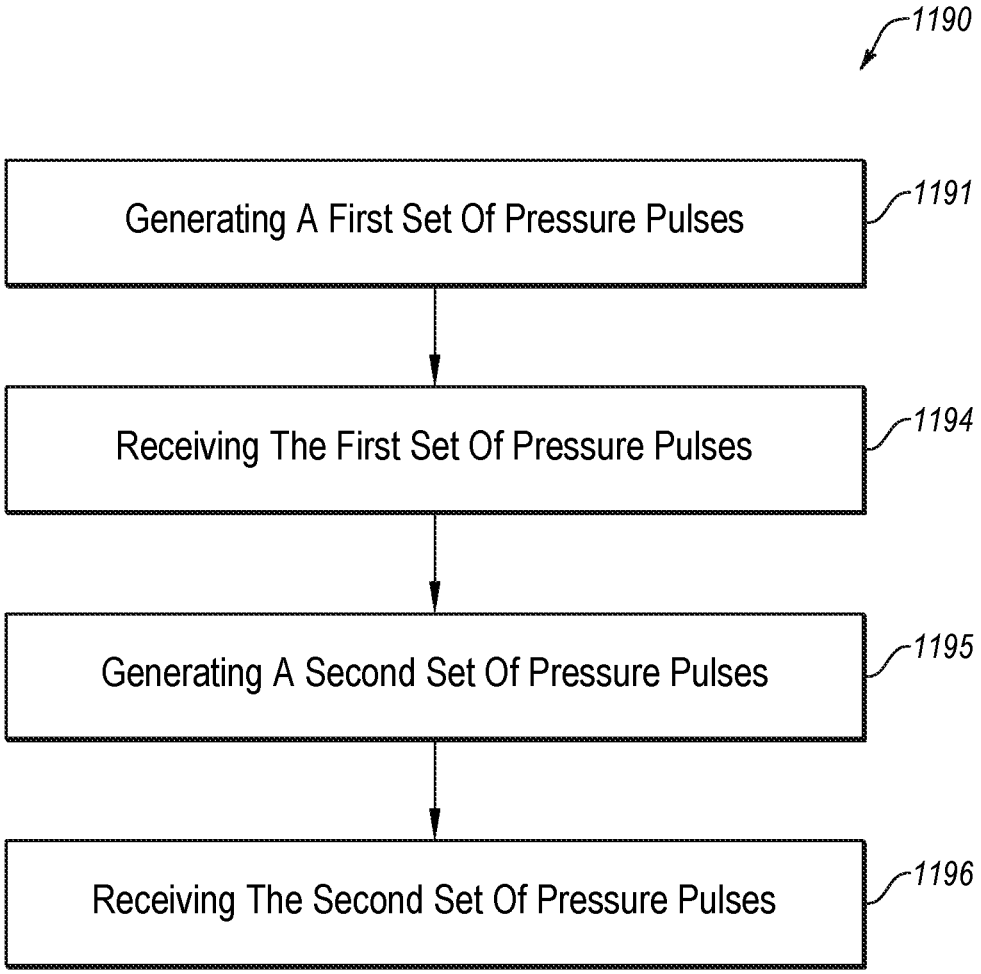
FIG. 11 is a method chart of another method for downhole communication, according to at least one embodiment of the present disclosure.

FIG. 11 is a method chart of a method 1190 for downhole communication. The method 1190 may include generating a first set of pressure pulses in a first pattern with a first frequency using a pressure pulse generator in communication with a roll stabilized platform at 1191. The mud pulse generator may be in communication with the roll stabilized platform by a downhole connection. The downhole connection may include a solenoid on the roll stabilized platform. Activating and deactivating the solenoid may actuate and de-actuate an actuation valve for the mud pulse generator. By activating and/or deactivating the solenoid in a pattern, the roll stabilized platform may communicate information to the mud pulse generator. The first pattern may include a first set of encoded data, or in other words, information may be encoded into the first pattern. The method 1190 may further include receiving the first set of pressure pulses at a first receiver at 1194. Receiving the first set of pressure pulses may include receiving the first set of pressure pulses at a surface location or at a downhole tool, or, in other words, the first receiver may be located at a surface location or at a downhole tool. The method may further include decoding the first set of encoded data with a processor in electronic communication with the first receiver.

The method 1190 may include generating a second set of pressure pulses in a second pattern with a second frequency at a downhole tool at 1195. The second pattern may include a second set of encoded data. The method 1190 may further include receiving the second set of pressure pulses at a second receiver at 1196. Receiving the second set of pressure pulses may include receiving the second set of pressure pulses at a surface location or at the downhole tool, or, in other words, the second receiver may be located at a surface location or at the downhole tool. The method may further include decoding the second set of encoded data with a processor in electronic communication with the second receiver.

In some embodiments, the method 1190 may include incorporating the first set of encoded data from the first set of pressure pulses into a second set of encoded data encoded into the second set of pressure pulses. In some embodiments, the first frequency and the second frequency may be the same. In this manner, the method 1190 may include waiting for an end of the first set of pressure pulses before generating the second set of pressure pulses at the downhole tool. This may include signaling the end of the first set of pressure pulses with an end-code at the end of the first set of pressure pulses.

In other embodiments, the first frequency and the second frequency may be different. In this manner, generating the first set of pressure pulses may at least partially temporally overlap, or at least partially overlap in time, generating the second set of pressure pulses. Therefore, receiving the second set of pressure pulses at the second receiver may include receiving the first set of pressure pulses at the second receiver. In other words, receiving the second set of pressure pulses may include simultaneously receiving the first set of pressure pulses and the second set of pressure pulses at the second receiver without losing any of the first set of encoded data or the second set of encoded data.

In some embodiments, the first receiver and the second receiver may be the same. For example, the downhole tool may not include a receiver, but may include a mud pulse generator. Therefore, the first set of pressure pulses may be generated at a roll stabilized platform and the second set of pressure pulses may be generated at different downhole tool. The first set of pressure pulses may have a different frequency than the second set of pressure pulses. Thus, a single receiver, or only one receiver, may receive both the first set of pressure pulses and the second set of pressure pulses. In some embodiments, the single receiver may be located at a surface location. In other embodiments, the single receiver may be located at a downhole location.

The embodiments of the communication system have been primarily described with reference to wellbore drilling operations; the communication systems described herein may be used in applications other than the drilling of a wellbore. In other embodiments, communication systems according to the present disclosure may be used outside a wellbore or other downhole environment used for the exploration or production of natural resources. For instance, communication systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

It should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A downhole communication system, comprising:

a roll stabilized platform;

a mud pulse generator;

a pilot valve including a moving member rotatable relative to the roll stabilized platform, wherein the moving member is movable from a first position to a second position to open a flow path to the mud pulse generator;

a solenoid;

a conductor attracted to the solenoid when the solenoid is activated;

a first gap between the solenoid and the conductor;

a second gap between the conductor and the moving member; and a receiver configured to receive a pressure pulse generated by the mud pulse generator.

2. The downhole communication system of claim 1, the receiver being located on a downhole tool.

3. The downhole communication system of claim 2, the receiver being located on a measuring while drilling ("MWD") sub.

4. The downhole communication system of claim 1, the receiver including a plurality of receivers.

5. The downhole communication system of claim 1, the roll stabilized platform including a rotary steerable system.

6. The downhole communication system of claim 1, the roll stabilized platform controlling the mud pulse generator.

7. The downhole communication system of claim 1, wherein the second gap is present between the conductor and the moving member when the moving member is in the second position.

8. A method for downhole communication, the method comprising:

generating a first set of pressure pulses using a mud pulse generator in communication with a roll stabilized platform, the first set of pressure pulses being generated in a first pattern having a first frequency, wherein generating the first set of pressure pulses includes the roll stabilized platform actuating a pilot valve for the mud pulse generator, wherein actuating the pilot valve includes actuating a moving member connected to the pilot valve, the moving member rotating at a different rotational rate than the roll stabilized platform;

receiving the first set of pressure pulses at a first receiver;

generating a second set of pressure pulses at a downhole tool, the second set of pressure pulses being generated in a second pattern having a second frequency; and receiving the second set of pressure pulses at a second receiver.

9. The method of claim 8, wherein actuating the pilot valve includes activating a solenoid rotationally fixed to the roll stabilized platform.

10. The method of claim 8, further comprising:

incorporating a first set of encoded data encoded into the first set of pressure pulses; and incorporating a second set of encoded data encoded into the second set of pressure pulses at the downhole tool.

11. The method of claim 8, further comprising measuring a measurement on the roll stabilized platform, and wherein the first set of pressure pulses being generated in the first pattern includes encoding the measurement into the first pattern.

12. The method of claim 11, the first receiver being located on the downhole tool, and further comprising changing at least one drilling parameter based on the measurement.

13. The method of claim 8, the first frequency being different than the second frequency.

14. The method of claim 8, wherein generating the second set of pressure pulses at the downhole tool includes generating the second set of pressure pulses with the mud pulse generator.

15. The method of claim 8, further comprising rotating the downhole tool at a different rotational rate than the roll stabilized platform.

* * * * *